United States Patent [19]

Bailey

[11] 4,114,265

[45] Sep. 19, 1978

[54] CAKE CUTTER AND SERVER

[76] Inventor: Robert L. Bailey, 3039-½ Eighth Ave., Los Angeles, Calif. 90018

[21] Appl. No.: 848,540

[22] Filed: Nov. 4, 1977

Related U.S. Application Data

[63] Continuation-in-part of Ser. No. 772,557, Feb. 28, 1977, abandoned.

[51] Int. Cl.[2] ..... B26B 11/00

[52] U.S. Cl. ..... 30/122

[58] Field of Search ..... 30/124, 122; 294/7, 294/8

[56] References Cited

U.S. PATENT DOCUMENTS

| | | | |
|---|---|---|---|
| 2,502,982 | 4/1950 | Norman | 30/122 |
| 2,845,705 | 8/1958 | Jenkinson | 30/122 |

*Primary Examiner*—Jimmy C. Peters
*Attorney, Agent, or Firm*—Warren T. Jessup

[57] ABSTRACT

A cake cutter and server which is formed of an integral piece of material. The server has a first enlarged section hingedly connected to a second triangular shaped section. Along the free edge of the second section is located a cutting edge. The second section is adapted to be pivoted to an approximately ninety-degree angle with respect to the first section. With the server used flat, a wedge shaped section of cake can be cut. Once cut, the wedge shaped section of cake can be readily removed by causing the second section to assume a right angle position to the first section and inserting the section under the section of cake and removing such. The second section is also adapted to be pivoted to the right or left to provide for use as a left-handed or right-handed server.

9 Claims, 8 Drawing Figures

CAKE CUTTER AND SERVER

This application is a continuation-in-part of application Serial No. 772,557, filed Feb. 28, 1977, now abandoned.

BACKGROUND OF THE INVENTION

The field of this invention relates to a kitchen utensil and more particularly to a pastry cutting and serving device.

Previously, there has been no known device which is specifically adapted for the cutting and serving of pastry, specifically cake. It is desirable that when cake is cut and served that the cake be served intact in a wedge shaped configuration. Previously, it has been easy to get the cake into a wedge shaped configuration but then to effect removal intact of the wedge shaped piece has not been easy. Actually, since most serving devices are rectangular in shape and comprise what is frequently termed as a spatula, the piece of cake will frequently crumble into a plurality of pieces. Also, if the flattened edge of an elongated knife is employed, the knife is just not wide enough to adequately support the piece of cake and again the piece of cake frequently crumbles into pieces.

Previously, there has been no known device which is designed in particular for the cutting and removing of a wedge shaped piece of cake intact.

SUMMARY OF THE INVENTION

The structure of this invention is believed to be summarily described in the Abstract Of The Disclosure and reference is to be had thereto.

The primary objective of this invention is to design as a single piece a device to facilitate cutting of a piece of cake from the overall cake and also to facilitate removing of the wedge shaped cut piece intact.

A further objective of this invention is to design a serving device which permits the removal of wedge shaped cut pieces of cake everytime the device is used with little fear of having the cut piece of cake fall into a plurality of pieces.

A further advantage of this invention is that the server is constructed of a single integral piece of material and can be manufactured in a single forming operation of plastic material.

Another advantage of this invention is that the server is constructed of a flexible material and can operate to facilitate left-handed or right-handed use.

Another advantage is that the cake cutter-server is flexible to provide for use with a variety of cooking pans having edges, rims or sides and can also be provided with flanges on both sides to permit the device to be reversed for left-handed or right-handed use, providing a versatility not available in prior art devices.

DETAILED DESCRIPTION OF THE SHOWN EMBODIMENT

Figure 1:
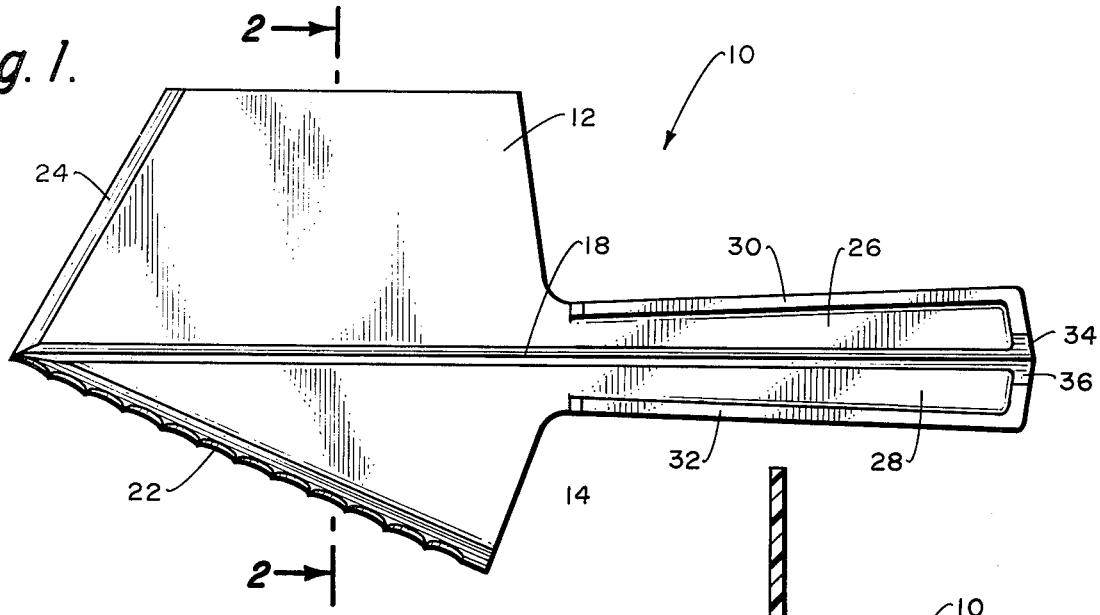
FIG. 1 is a plan view of the server of this invention.

Referring particularly to the drawing, there is shown the server 10 of this invention which is composed basically of a thin plastic material, such as a polyethyline or a polystyrene plastic. The server 10 is composed of a first section 12 and a second section 14. The first section 12 is substantially rectangular in shape with the second section 14 substantially triangular in shape. The triangular shaped second section is of specific advantage so that when the device is used as a server and located in the position of FIG. 3, that the second section 14 is located substantially entirely beneath the cut wedge shaped section of pastry 16.

Separating the first section 12 from the second section 14 is an elongated V-shaped groove 18 in cross-section. As a result of the groove 18, there is formed a thin strip 20 of material which interconnects the sections 12 and 14. It is this strip of material which permits the hinging movement between the first section 12 and the second section 14. This type of hinge is well known and is frequently called a "living hinge".

Figure 4:
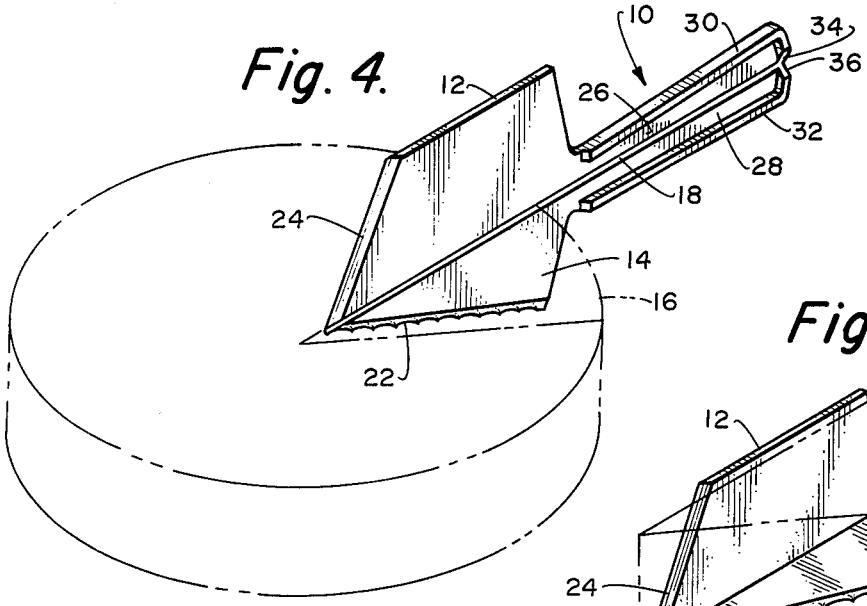
FIG. 4 is an isometric view depicting use of the server of this invention to effect the cutting operation.
Figure 5:
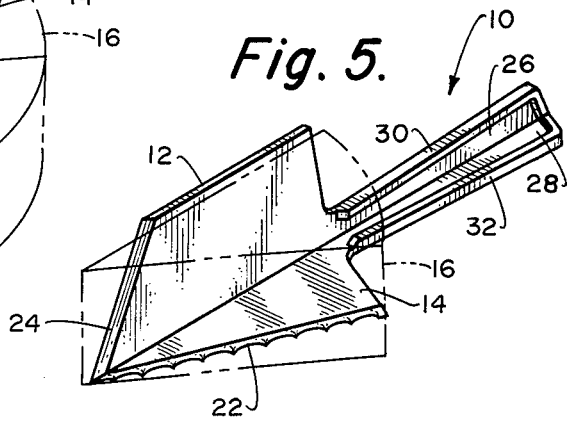
FIG. 5 is an isometric view of the server of this invention depicting the use of the device to remove a cut wedge shaped section of cake.

The longest free edge of the second section 14 is beveled and scalloped to form a sharpened edge 22. This sharpened edge 22 is to facilitate the cutting of the wedge section 16 from an entire cake, such as depicted in FIG. 4 of the drawing. It is to be noted that the front edge of the section 12 forms a bevel 24 to facilitate the cutting action.

Integrally attached to the first section 12 is a first handle section 26. Integrally attached to the second section 14 is a second handle section 28. The handle sections 26 and 28 are also connected together through the V-shaped groove 18 which is extended to be located between the handle sections 26 and 28. The peripheral edges of the handle sections 26 and 28 include an outwardly extending flanges 30 and 32, respectively. The flanges 30 and 32 provide some width to the handle sections 26 and 28 so as to provide sufficient handle structure which can be readily grasped.

Figure 3:
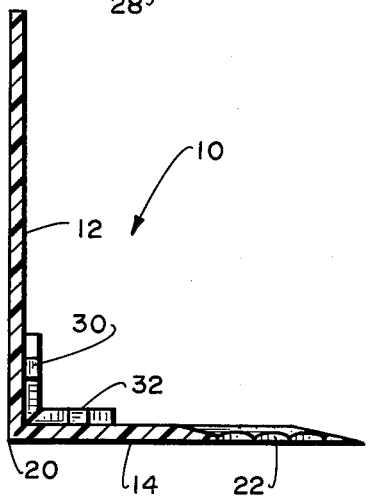
FIG. 3 is a cross-sectional view similar to FIG. 2 but showing the server in a right angle position.

At the outer edge of the handle section 26, the flange 30 is beveled at forty-five degrees to form a first beveled section 34. A similar beveled section 36 is formed within the flange 32 directly adjacent the section 34. The purpose of the beveled sections 34 and 36 is that when the device is in the position shown in FIG. 3, the sections 34 and 36 contact each other which thereby functions as a stop to limit the angular movement of the second section with respect to the first section to a right angle position as shown in FIG. 3.

In operation of the server of this invention, the device is used flat as shown in FIG. 4 to cut a wedge shaped piece of cake from the cake. After the piece 16 of cake is cut, the server is removed and placed in the position of FIG. 3. The server is then inserted so the second section 14 is located directly beneath the cake section 16. The first section 12 is located along one side of the wedge 16 of cake. The operator then lifts the wedge 16 from the cake and then places such where desired. As the wedge 16 is being lifted, it is generally desirable to slightly tilt the wedge 16 against the first section 12 for support.

Figure 6:
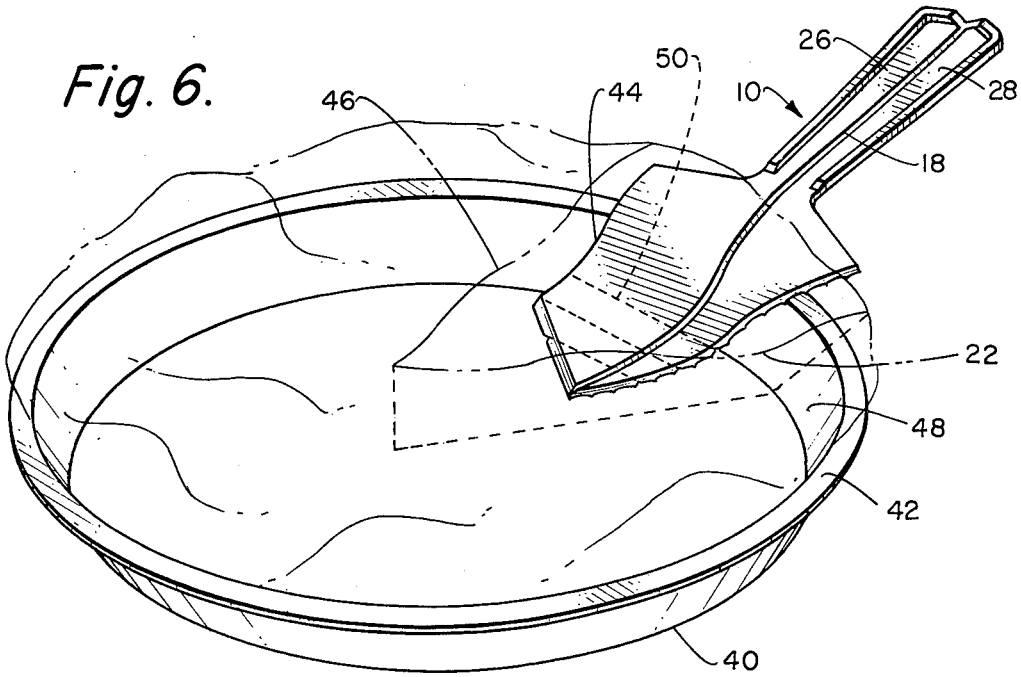
FIG. 6 illustrates the versatility of the flexible server for use with lipped pans

Another adventage of the unitary homogeneous design of applicant's cake cutter-server is illustrated in FIG. 6. Other foods other than cakes are frequently cooked in pans 40 which have a lip 42 making it difficult to remove the slice of pie or other food serving with previous devices. However, applicant's device, because of its homogeneous unitary flexible design, can flex as shown at 44 to slide beneath a serving 46 for removal after cutting. The server 10 will flex at 44 as shown, sliding down the inside edge 44 beneath the serving 46, allowing the serving to be easily served from this type of container 40.

For very deep cooking untensils or pans, the flexibility of the cake cutter-server can be enhanced by adding serveral V cuts in the blades 12 and 14, substantially perpendicular to the V-groove 18 indicated by dotted lines 50 in FIG. 6. Referring to the embodiment in FIG. 7, three V-grooves 52, 54 and 56 spaced approximately as shown, perpendicular to the V-groove 18, can be cut across the blades 12 and 14 for increased flexibility. While three V-grooves have been shown, more or less may be provided, but at least two are preferred. The cuts 52, 54 and 56 would be shallow and on one side of the blades 12 and 14 only.

Figure 8:
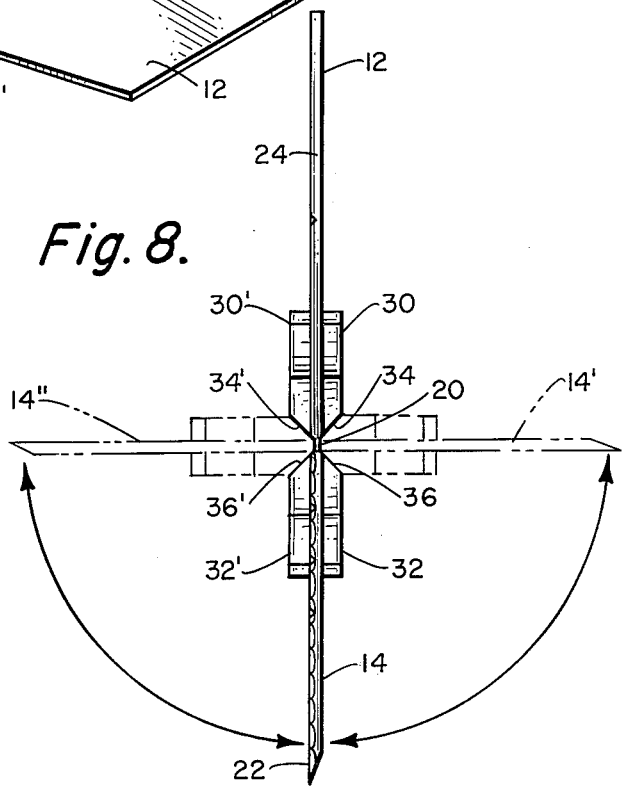
FIG. 8 is an end view of the cake cutter-server taken from FIG. 7 shown vertically with left and right motion indicated in phantom.

The addition of these V-grooves across the blades 12 and 14 does not substantially affect the strength of the cutter-server as these cuts provide hinges which allow the tip to flex when the cake cutter-server is flat, but cannot flex when the blades 12 and 14 are slightly folded or for serving as illustrated in FIG. 8.

Figure 2:
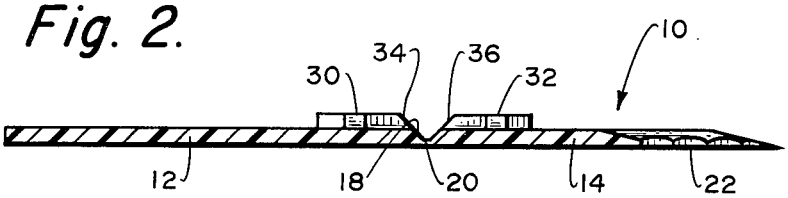
FIG. 2 is a cross-sectional view taken along line 2—2 of FIG. 1.
Figure 7:
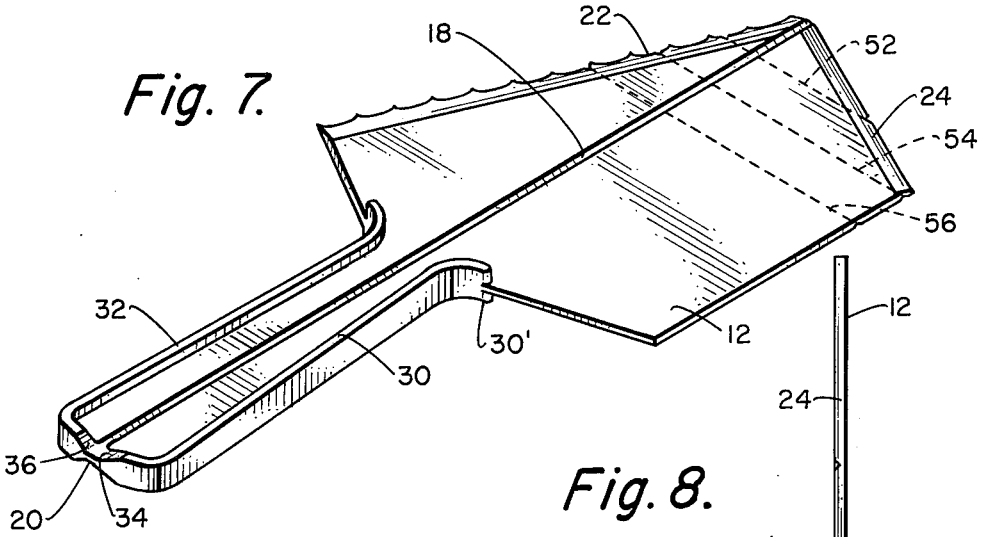
FIG. 7 illustrates an alternate embodiment of the cake cutter-server of FIGS. 1–3.

The cake cutter-server illustrated in FIGS. 1 through 6 can fold in either direction along strip 20, shown in FIGS. 2 and 3, allowing use by right-handed or left-handed people. To facilitate use by left-handed people the cake cutter-server can be constructed as illustrated in FIGS. 7 and 8. This is accomplished by providing reinforcing flanges 30' and 32' on the opposite side of the server handle, and identical to stiffening flanges 30 and 32. Likewise 45° bevelled edges 34' and 36' are provided on the opposite side of the server to provide a stop for using the server in the left-hand configuration.

For use by a right-handed person, blade 14 is rotated to the position shown in phantom lines indicated at 14' with bevelled edges 34 and 36 in engagement as illustrated in FIG. 3. For use by a left-handed person, the bevelled edges 34' and 36' are brought into engagement by rotating cutting edge blade 14 into the position as illustrated at 14''. The device illustrated in FIG. 8 has the same thin strip 30 of material connecting the sections 12 and 14 as before.

Viewing the server in its flat cutting position as illustrated in FIG. 8, rotation of the blade 14 to the right, with blade 14' in the position shown in phantom provides for right-handed use. For left-hand use, the blade 14 may be easily rotated to the left with bevelled edges 34' and 36' coming into engagement to stop blade 14 as illustrated at 14''.

Thus there has been disclosed a cake cutter-server which is flexible to provide for a use with a variety of cooking pans having edges, rims, or sides and can also be provided with flanges on both sides of the handle to permit the device to be easily reversed for left-handed or right-handed use. The novel cake cutter-server disclosed herein provides a versatility not available in prior art devices.

What is claimed is:

1. A pastry cutter and server comprising:

a body section being divided into a first section and a second section, said first section being pivotally connected by hinge means to said second section;

a first handle section attached to said first section;

a second handle section attached to said second section, said first and second handle sections cooperating together to form a single handle structure;

said second section having a sharpened edge on the free edge thereof, whereby said sharpened edge may be used to cut through pastry when the first section is in alignment with the second section;

said hinge means permitting said first and second sections to be rotated right or left until said first and second sections are located at substantially right angles to one another whereby said cutter may now be employed as a left or righthanded server.

2. The server as defined in claim 1 wherein:

said hinge means comprises an integral flexible web connecting said first and second sections.

3. The server as defined in claim 2 wherein:

said first and second handle sections are hingedly connected by a continuation of said thin flexible web serving as the hinge for the first and second sections.

4. The server as defined in claim 3 wherein:

said first and second handle sections include hinge stop means whereby said first and second sections are automatically stopped at substantially right angles.

5. The server as defined in claim 4 wherein said hinge stop means comprises:

a flange around the outside edge of each said handle section;

a bevel in each flange oppositely angled at 45° when said handle flange bevels are brought into engagement said first and second sections are automatically stopped at substantially right angles.

6. The server as defined in claim 5 wherein:

said flange extends around the periphery on both sides of said first and second handle sections;

said oppositely angled bevels are provided on both sides of said handle whereby said bevels operate as automatic stops for left-hand or right-hand use of said server.

7. The server as defined in claim 1 wherein said first and second sections are formed of a flexible material whereby said server may be used with cooking utensils having a lip.

8. The server as defined in claim 1 including:

a plurality of shallow V-grooves across said first and second sections substantially perpendicular to said hinge means whereby the flexibility of said first and second sections are enhanced for use with deep-dish cooking utensils.

9. The server as defined in claim 1 wherein:

said first section being substantially greater in area than the area of said second section.

* * * * *